US007653949B2

(12) United States Patent
Kraus et al.

(10) Patent No.: US 7,653,949 B2
(45) Date of Patent: Feb. 2, 2010

(54) MITTEN-SLEEVE COMBINATION FOR A WINTER GARMENT

(76) Inventors: Trisha Kraus, 6792 Quarterhorse Dr., Springboro, OH (US) 45066; Lori Mascall, 804 Woodlawn Ct., Lebanon, OH (US) 45036

( * ) Notice: Subject to any disclaimer, the term of this patent is extended or adjusted under 35 U.S.C. 154(b) by 212 days.

(21) Appl. No.: 11/383,542

(22) Filed: May 16, 2006

(65) Prior Publication Data

US 2006/0260019 A1 Nov. 23, 2006

Related U.S. Application Data

(60) Provisional application No. 60/681,761, filed on May 17, 2005.

(51) Int. Cl.
*A41D 1/02* (2006.01)
*A41D 3/02* (2006.01)
*A41D 19/00* (2006.01)

(52) U.S. Cl. ..... 2/93; 2/158

(58) Field of Classification Search ..... 2/158, 2/159, 160, 167, 108, 170, 161.8, 16, 93, 2/84, 80, 75, 111, 69.5
See application file for complete search history.

(56) References Cited

U.S. PATENT DOCUMENTS 910,485 A * 1/1909 Baumann ..... 2/83
1,271,017 A * 7/1918 Cassidy ..... 441/104
1,296,966 A 3/1919 Kaufman
1,926,194 A * 9/1933 White ..... 2/111
1,944,451 A * 1/1934 Newman ..... 128/874
2,030,091 A * 2/1936 Behringer ..... 2/114
2,130,771 A * 9/1938 Mann ..... 2/69.5
2,181,159 A * 11/1939 Temple ..... 441/103
2,340,017 A * 1/1944 Rasmussen ..... 2/270
2,497,764 A * 2/1950 Doughty ..... 2/114
2,578,323 A * 12/1951 Sillaway ..... 2/69.5
2,615,165 A * 10/1952 Steedman ..... 2/80
2,675,554 A 4/1954 Gertz
2,677,130 A * 5/1954 O'Hayer ..... 2/75
2,680,849 A * 6/1954 Munro ..... 2/69.5
2,697,837 A * 12/1954 Goldman ..... 2/270
2,738,512 A * 3/1956 Winer ..... 2/80
3,214,771 A * 11/1965 Treiber ..... 2/270
3,727,236 A 4/1973 Lloyd et al.
D241,185 S 8/1976 Schlechter
4,016,027 A 4/1977 Kintanar
4,023,223 A * 5/1977 Anderson et al. ..... 441/104
4,038,698 A * 8/1977 Smith ..... 2/79

(Continued)

*Primary Examiner*—Alissa L Hoey
(74) *Attorney, Agent, or Firm*—Hasse & Nesbitt LLC; Ronald J. Richter; Donald E. Hasse

(57) ABSTRACT

A winter weather garment, such as an undergarment or a middle layer of winter wear, which has mittens with an extended forearm section permanently attached to the end of the sleeves so that the elements of winter never come into contact with the wearer's forearm or wrist area. The garment typically precludes the wearer, such as a child, from removing the mitten end without the assistance of an adult. The garment typically has a torso portion for substantially covering the torso of the wearer, a left distal portion, and a right distal portion, with each distal portion being permanently attached to the torso portion and protecting the respective left or right hand, wrist and forearm of the wearer from the outside elements.

6 Claims, 4 Drawing Sheets

U.S. PATENT DOCUMENTS 4,258,438 A 3/1981 Kirchner
4,297,746 A 11/1981 Zarbos
4,308,622 A * 1/1982 Maddron ..... 2/79
4,359,784 A * 11/1982 Harrington ..... 2/269
4,383,336 A * 5/1983 Beckman et al. ..... 2/158
4,559,647 A * 12/1985 Smith et al. ..... 2/158
4,704,092 A * 11/1987 Liukko ..... 441/104
4,756,027 A * 7/1988 Buenos et al. ..... 2/123
4,759,082 A * 7/1988 Mulligan ..... 2/69.5
4,764,985 A * 8/1988 Wade ..... 2/88
4,783,858 A * 11/1988 Chevalier ..... 2/90
4,815,480 A 3/1989 Martin
4,868,928 A * 9/1989 Norvell ..... 2/272
4,944,041 A * 7/1990 Buenos et al. ..... 2/84
4,947,867 A * 8/1990 Keeton ..... 128/846
5,005,216 A * 4/1991 Blackburn et al. ..... 2/79
5,117,507 A * 6/1992 Long ..... 2/158
5,125,117 A * 6/1992 Buenos et al. ..... 2/239
5,138,717 A * 8/1992 Tolton ..... 2/123
5,204,156 A * 4/1993 Lumb et al. ..... 428/96
5,268,212 A * 12/1993 Lumb et al. ..... 428/96
5,361,415 A * 11/1994 Deering et al. ..... 2/158
5,364,678 A * 11/1994 Lumb et al. ..... 428/96
5,418,979 A * 5/1995 Senderowicz ..... 2/75
5,469,581 A * 11/1995 Uthoff ..... 2/69
5,504,944 A * 4/1996 Bromer et al. ..... 2/269
5,516,321 A * 5/1996 Kornbleuth ..... 446/28
5,526,532 A * 6/1996 Willard ..... 2/69
5,561,860 A * 10/1996 Nguyen-Senderowicz ..... 2/90
5,572,742 A * 11/1996 McFadden ..... 2/114
5,611,087 A * 3/1997 Adkins ..... 2/114
5,652,962 A * 8/1997 Patnode ..... 2/114
5,784,720 A * 7/1998 Mellon et al. ..... 2/125
5,794,265 A * 8/1998 Reich ..... 2/125
5,815,837 A * 10/1998 Christman et al. ..... 2/158
5,913,408 A * 6/1999 Shanahan ..... 2/90
5,918,314 A * 7/1999 Moses ..... 2/79
5,933,864 A * 8/1999 Boykins ..... 2/69
5,953,758 A * 9/1999 Foster ..... 2/268
6,035,441 A * 3/2000 Mellon et al. ..... 2/125
6,076,189 A * 6/2000 Christman et al. ..... 2/158
6,148,444 A * 11/2000 Holmes et al. ..... 2/69
6,240,561 B1 * 6/2001 McGinnis ..... 2/69.5
6,249,916 B1 * 6/2001 Mellon et al. ..... 2/125
6,253,381 B1 * 7/2001 Kelley ..... 2/125
D449,422 S 10/2001 Massie
6,363,534 B1 4/2002 Clough
6,839,911 B1 * 1/2005 Mathews ..... 2/93
6,859,942 B1 * 3/2005 Cratty ..... 2/88
6,996,847 B2 * 2/2006 Anderson et al. ..... 2/16
7,047,569 B1 * 5/2006 Mahon et al. ..... 2/88
7,290,291 B2 * 11/2007 Anderson et al. ..... 2/159
7,310,825 B2 * 12/2007 St-Germain ..... 2/123
D563,628 S * 3/2008 Corbin et al. ..... D2/831
7,530,118 B2 * 5/2009 Osborne et al. ..... 2/69.5
2003/0126675 A1 * 7/2003 Blauer et al. ..... 2/456
2003/0154536 A1 * 8/2003 Anderson et al. ..... 2/108
2004/0143884 A1 * 7/2004 Majerfeld ..... 2/96
2005/0075028 A1 * 4/2005 Rock et al. ..... 442/318
2005/0214501 A1 * 9/2005 Baychar ..... 428/90
2006/0075538 A1 * 4/2006 Anderson et al. ..... 2/69
2006/0075539 A1 * 4/2006 Anderson et al. ..... 2/108
2007/0245448 A1 * 10/2007 Bury ..... 2/108
2007/0266473 A1 * 11/2007 Issel ..... 2/84

* cited by examiner

MITTEN-SLEEVE COMBINATION FOR A WINTER GARMENT

CROSS-REFERENCE TO RELATED APPLICATION

This application claims the benefit of U.S. Provisional Application No. 60/681,761, filed on May 17, 2005.

FIELD OF THE INVENTION

The present invention relates generally to articles of clothing for thermal protection, and more particularly to a mitten-sleeve combination for a winter garment.

BACKGROUND OF THE INVENTION

Sleeves of thermal-protection garments such as coats, jackets, and undergarments generally end at the wrist, leaving the hands and fingers unprotected from cold, requiring gloves or mittens.

Gloves and mittens traditionally have the disadvantages of needing to be carried separately from the coat or jacket, and so frequently are lost. This can be a serious problem for skiers or outdoor users, and a great nuisance for the parents of small children. Also, since gloves and mittens typically cause the wearer to lose dexterity, both children and adults alike are prone to remove the gloves or mittens in order to more easily grasp ski poles, fashion snowballs, etc., thereby adding to the chance that the removed article will be lost. Indeed, fingerless gloves have been developed to address this problem by keeping the hand properly covered while leaving the fingers, or some portion of the fingers, uncovered for better dexterity. But even fingerless gloves can be lost if they are not attached to a coat or garment.

Numerous systems for preventing glove loss have been developed, such as by a string attached to mittens and looped around the neck, clips, zippers or buttons removably attaching the gloves to the sleeves, and so on. Several garments known in the prior art disclose mittens or gloves permanently attached to a coat or other garment. For example, U.S. Pat. No. 1,296,966 to H. A. Kaufman, U.S. Pat. No. 2,675,554 to P. L. Gertz, U.S. Pat. No. 4,359,784 to Harrington, and U.S. Pat. No. 4,297,746 to Zarbos all disclose outer garments with a combined sleeve and mitten/glove attachment. However, all of these prior art documents disclose a means to remove the hand from the mitten or glove without removing the outer garment. The gloves or mittens typically can be removed by the user through a slit or hole therein, tempting a child or adult to brave the cold and wet in exchange for better dexterity. Further, snow is able to enter through the hole or slit in the mitten and reach the skin, making play uncomfortable.

Some prior art patents disclose garments with gloves or mittens attached to the sleeves in which the hand cannot be removed therefrom, such as through a hole or slit in the mitten. For example, U.S. Pat. No. 4,815,480 to Martin discloses a garment for abnormal persons having a compulsion for destructive activity. The garment includes large mitts attached thereto for controlling excessive hand activity. Each mitt includes many "envelopes" of material which are designed to completely enclose the hand and keep the wearer from grasping things. While this invention is useful for the particular problem it solves, a normal child or adult playing in the snow should not be so restrained, such that it is highly desirable that any permanently attached gloves or mittens allow the wearer to grasp items.

U.S. Pat. No. 4,016,027 to Kintanar teaches cosmetic gloves which extend up the arm of the wearer and are joined together about the shoulders of the wearer. These gloves are provided for cosmetic purposes and are not suited for keeping the user's hands warm and dry in cold weather. U.S. Design Pat. No. D241,185 to Schlechter shows a cosmetic type fishnet garment which is provided for ornamental purposes wherein fill length arms and gloves are provided; however such a garment is not functional for winter weather use. U.S. Design Pat. No. D449,422 to Massie likewise teaches a mitten garment which extends up the arms and joins about the shoulders; however the mittens are not permanently attached to any garment.

Finally, there have been attempts to keep the mittens or gloves on the wearer, such as a small child, by providing elongated portions attached to the glove which extend up the forearm of the wearer. U.S. Pat. No. 6,363,534 to Clough teaches a protective mitten with a long elasticized snow sleeve or band that covers a major portion of the forearm of a child. While this invention teaches the aspects of wrist protection from the cold and snow, the long sleeve is not attached to an undergarment, is prone to "bunch" and become uncomfortable, and can easily be removed by the wearer.

In light of the above, it would be advantageous to provide a garment which includes mittens or gloves attached to the sleeves. It would also be advantageous to provide a mitten-sleeve combination garment which precludes a child from removing their mittens while out in the snow without the assistance of an adult. It would also be advantageous to provide mittens or gloves which are permanently attached to the sleeve of an undergarment so that they cannot be lost or removed without first removing the garment. It would also be advantageous to provide a garment that adequately prevents snow from coming into contact with the skin around the wrist area, where there is traditionally a gap in the mitten/coat coverage. It would also be advantageous to provide mittens with extended sleeves that are not prone to "bunch" or fall down to the wrist and become uncomfortable to the wearer.

SUMMARY OF THE INVENTION

The present invention provides the advantages listed above in the form of a garment for protecting the hands, wrists and forearms of a wearer from winter weather. The garment is typically designed to prevent the wearer, such as a child, from removing their gloves or mittens while the garment is being worn.

A first aspect of the invention is a garment for impeding the outside elements from contacting the hands, wrists and forearms of a wearer, the garment comprising (a) a torso portion for substantially covering the upper body of a wearer; (b) a left distal portion; and (c) a right distal portion, wherein each distal portion is permanently attached to the respective side of the torso portion and is configured to cover the respective hand, wrist and forearm of the wearer.

A second aspect of the invention is a garment for impeding the outside elements from contacting the hands, wrists and forearms of a wearer, the garment comprising (a) a torso portion for substantially covering the upper body of the wearer, the torso portion comprising a left proximal extremity portion and a right proximal extremity portion, each proximal extremity portion configured to cover the respective shoulder and upper arm of the wearer; (b) a left distal portion permanently attached to the left proximal extremity portion; and (c) a right distal portion permanently attached to the right proximal extremity portion, wherein each distal portion is configured to cover the respective hand, wrist and forearm of the wearer.

A third aspect of the invention is an undergarment for protecting the hands, wrists and arms of a wearer from the outside elements, the undergarment comprising (a) a torso portion for substantially covering the upper body of a wearer, the torso portion comprising a left proximal extremity portion and a right proximal extremity portion, each proximal extremity portion configured to cover the respective shoulder and upper arm of the wearer; (b) a left distal portion; and (c) a right distal portion, wherein each distal portion is permanently attached to the respective proximal extremity portion and is configured to cover the respective hand, wrist and forearm of the wearer.

Typically each of the distal portions has an innermost layer, an outer layer, and an outer-most layer, wherein both the inner-most layer and the outer layer completely cover the hand, wrist and forearm of the wearer, and the outer-most layer acts as a gripping pad, covering the outer layer at the palm, thumb and finger areas of the hand portion. Further, each of the distal portions typically has a forearm portion for receiving a forearm of the user, an elasticized wrist portion for receiving a wrist of the user, and a hand portion for receiving a hand of the user, wherein each hand portion of each distal portion is selected from the group consisting of a mitten, a glove, and a fingerless glove.

The nature and advantages of the present invention will be more fully appreciated from the following drawings and detailed description.

BRIEF DESCRIPTION OF THE DRAWINGS

The accompanying drawings illustrate embodiments of the invention and, together with a general description of the invention given above, and the detailed description given below, serve to explain the principles of the invention.

DETAILED DESCRIPTION OF THE INVENTION

As used herein, the term "elasticized" means a garment or portion thereof made with strands or inserts of elastic, or made from a material that has elastic properties.

As used herein, the term "outside elements" means generally rain, snow, freezing rain, and cold, biting winds.

As used herein, the phrase "permanently attached" when referring to the attachment of a distal portion to the torso portion of the garment means that a distal portion is annularly attached, either partially or completely, to a proximal extremity portion of the torso portion. While the preferred embodiment of the garment of the invention includes permanent and complete annular attachment by way of the distal portion having been sewn or hemmed together with the proximal extremity portion, it is understood that such "permanent attachment" can also include a semi-permanent yet detachable means, such as via annularly-placed hook-and-loop fasteners, buttons, zippers or the like, and that the annular attachment around the proximal extremity portion can be partial or complete.

As used herein, the terms "water-resistant" and "weather-resistant" are interchangeable and mean generally resisting the effects of severe weather, as rain, wind or cold, such as a weather-resistant cloth, and more specifically meaning resisting, though not entirely preventing, the penetration of water.

As used herein, the term "waterproof" means impervious to water, or rendered impervious to water by some special treatment process, such as by coating or treating with a waterproof substance.

The present invention provides a garment, such as a middle layer or undergarment of winter wear, which has elongated mittens covering the forearms. The mittens are typically permanently attached to the ends of the sleeves so that the elements of winter never come into contact with the wearer's skin at the wrist and forearm area. The garment typically precludes the wearer, such as a child, from removing the mittens from their hands without the assistance of an adult and precludes the wearer from losing the mittens while playing outside.

Figure 1:
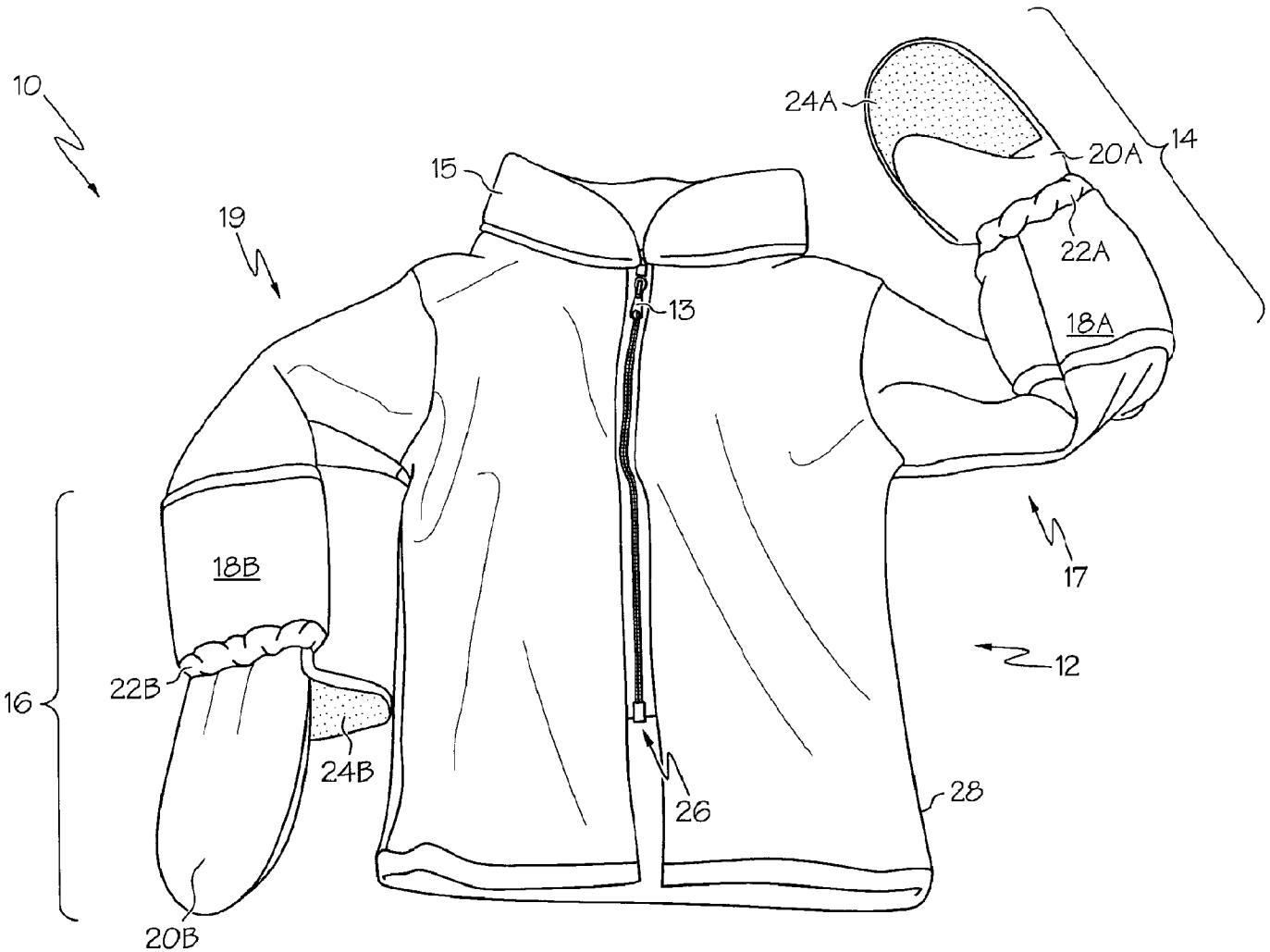
FIG. 1 is a perspective view of the front side of one embodiment of a garment of the present invention.

Looking at FIG. 1, garment 10 is a first embodiment of the invention that includes a torso portion 12 attached to a left distal portion 14 and a right distal portion 16. The torso portion 12 typically includes a front opening means such as a zipper 13 to fully open and close the front thereof, and a collar 15 attached to the neck region of the torso portion 12. The torso portion 12 also includes a left proximal extremity portion 17 and a right proximal extremity portion 19. Typically each proximal extremity portion 17, 19 covers the respective left or right shoulder and the left or right upper arm of the wearer, and each distal portion 14, 16 is permanently attached to its respective left or right proximal extremity portion 17, 19 of the torso portion 12.

While a full-length zippered opening is shown in FIG. 1, the front of the torso portion 12 need not have a front opening means at all, or the opening may include buttons, or the torso portion may be only partially open down to the chest line. As shown in FIG. 1, each of the distal portions 14, 16 include smaller, distinct portions. More specifically, the left distal portion 14 includes a forearm portion 18A, a hand portion 20A, an elasticized wrist portion 22A, and a gripping surface 24A, while the right distal portion 16 includes forearm portion 18B, hand portion 20B, elasticized wrist portion 22B, and gripping surface 24B. The gripping surfaces 24A, 24B are an outer-most layer, and are typically pads of material placed over the thumb, palm and finger portions of the hand portions 20A, 20B. The outer-most layer gripping surfaces 24A, 24B are typically made of a tough material such as waterproof leather, rubber or nylon. This outer-most layer is typically located only over the palm, thumb and finger areas of the hand portions. Alternatively, the entire hand portion can be coated with the waterproof material, or the entire distal portion can be so coated.

Typically, the main bodice or torso portion 12 of the garment 10, including the left and right proximal extremity portions 17, 19, is typically constructed of any cotton type material, but the material is not limited to this material and can include any light-weight and comfortable material known in the art which is suited for wearing beneath an overcoat or sweater. In use, the torso portion 12 of the garment is generally intended to comfortably fit as a light layer of clothing under a heavier, separate overcoat and/or sweater. The collar 15 is optional, and typically extends out of the neck line of the overcoat/sweater, for keeping the user's neck warm. In one embodiment, the collar can be a hood. The forearm portions 18A, 18B are generally intended to fit beneath the sleeves of the overcoat/sweater, and the hand portions 20A, 20B and the elasticized wrist portions 22A, 22B typically extend out from the sleeves of the overcoat/sweater worn over the garment 10. However, use of the garment 10 is not restricted to being used in this way, such that the garment 10 can also be worn as a top layer of clothing, if desired.

The hand, wrist and forearm portions of the distal portions 14, 16, as well as the optional collar 15 and/or hood, if included, typically include an outer layer made of a weather-resistant material, such as treated fleece, and an inner-most layer or lining of cotton or any other soft, light-weight and comfortable material known in the art which is suited for wearing against the skin. The use of a weather-resistant material helps to ensure that the distal portions 14, 16, having been exposed to cold, snow or rain, prevent the outside elements from easily penetrating to the skin of the forearms, wrists and palms of the user. Similarly, the use of a waterproof material on the gripping surfaces 24A, 24B creates a buffer between the user's skin and the outside elements by preventing melted snow, rain or water from completely penetrating through the heavily-used palmar areas of the hands, rendering the user's hands wet, cold and, ultimately, in need of removal of the garment.

Figure 4:
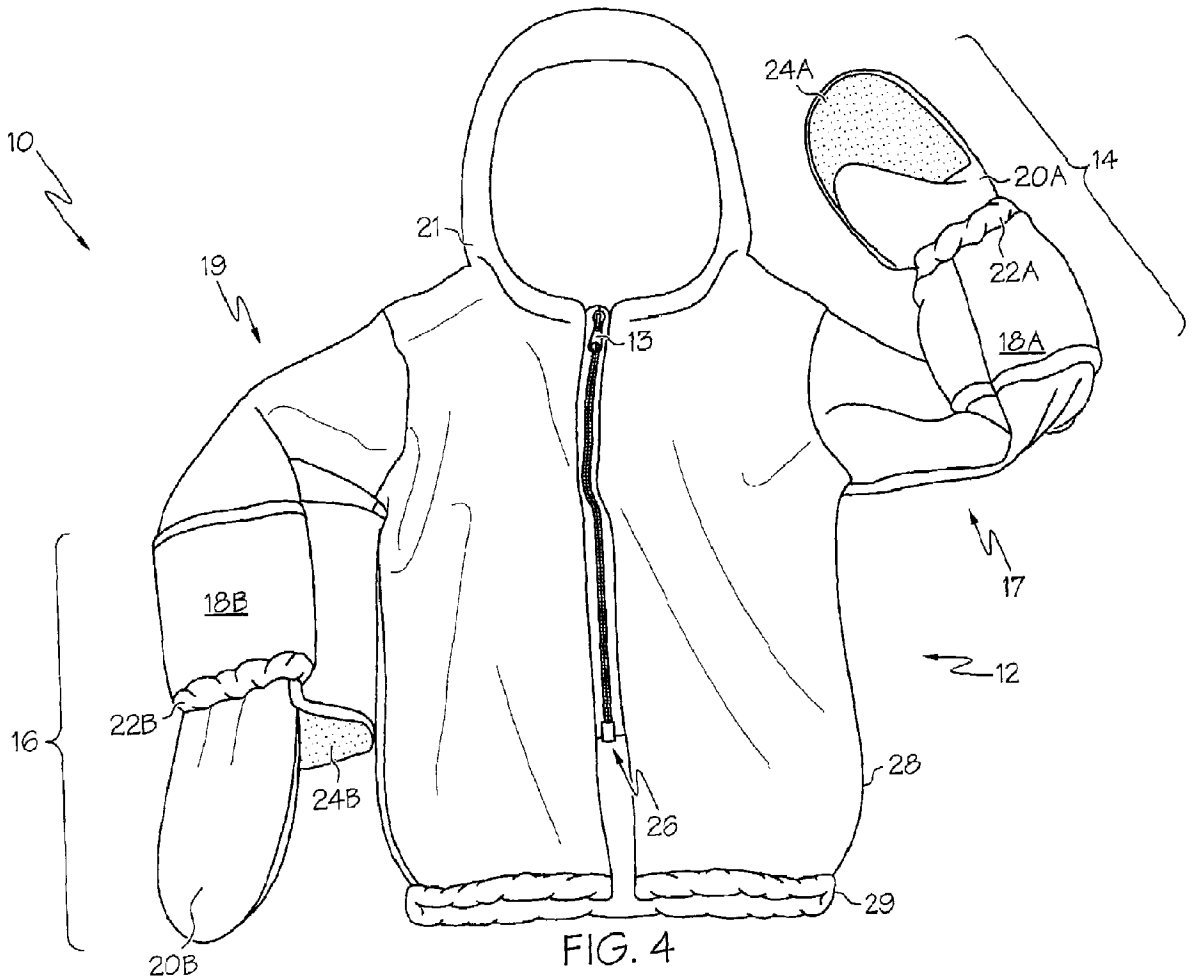
FIG. 4 is a perspective view of the front side of one embodiment of the garment of the present invention.

FIG. 1 also illustrates the waist area of the torso portion 12 having a straight and elongated tail 28, similar to the tail of a dress shirt, so that the torso portion 12 of the garment 10 can be tucked into the pants of the wearer. This elongated tail 28 typically extends below the level of the zipper end 26, which typically terminates at or about the waist of the user. Thus, it can be appreciated that the tail 28 extends below the waist of the user and can be tucked in for protective comfort while the user is outdoors in cold weather. In another embodiment, shown in FIG. 4, the tail 28 also has an elasticized, portion 29, similar to the elasticized wrist portions 22A, 22B. In the embodiment, shown, the tail 28 is elongated to extend below the level of the zipper end 26, and the elasticized portion 29 serves to keep this elongated tail portion 28 close to the body. The garment 10 of FIG. 4 also includes a hood 21 attached to the neck region of the torso portion 12.

Figure 2:
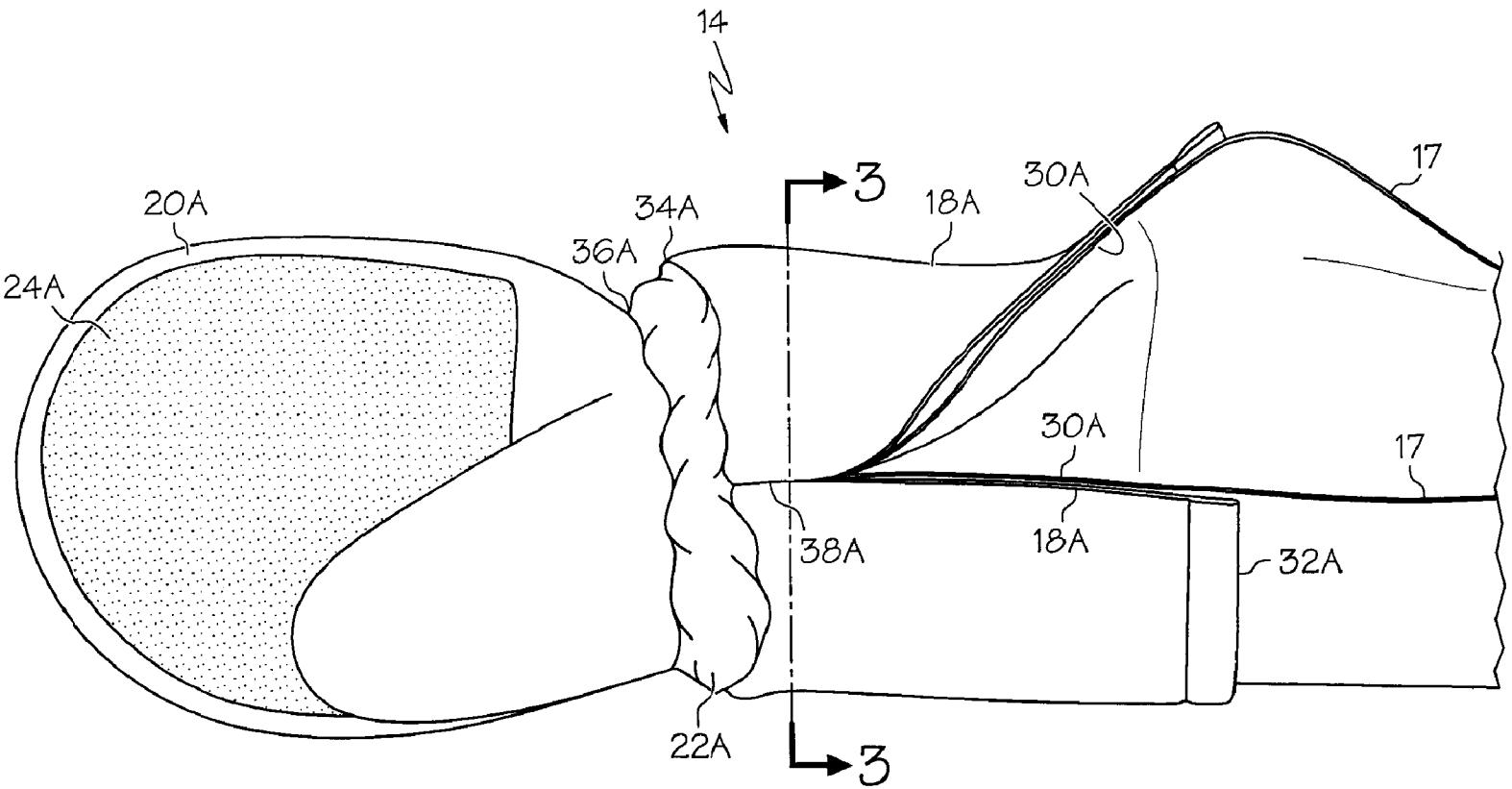
FIG. 2 is a perspective view of the different layers of a distal portion of one embodiment of a garment of the present invention.

FIG. 2 illustrates a perspective view of a left distal portion 14 of the garment (typically the elements of the right distal portion 16 are identical to the left 14) which has been cut along seam 38 to expose a first junction 32A between the forearm portion 18A and the left proximal extremity portion 17. The left distal portion 14 typically has an inner-most lining 30A beneath a continuous outer layer which makes up the left forearm portion 18A, the left wrist portion 22A, and the left hand portion 20A. As shown in FIG. 2, inner-most lining 30A is typically continuous with the proximal extremity portion 17 at the first junction 32A, where it is hemmed or sewn together (not shown) with the outer layer of the forearm portion 18A. The hem at the first junction 32A acts to anchor the two layers of materials together, and creates a border where a single lining 17 becomes a double lining 30A, 18A. The inner-most lining 30A thus typically begins at the first junction 32A, passes beneath the outer layer of the forearm portion 18A, and is then typically hemmed at a second junction 34A between the forearm portion 18A and the wrist portion 22A, thereafter continuing beneath the outer layer of the wrist portion 22A and the hand portion 20A. An elastic band is typically sewn to the inner-most lining to create a third junction 36A between the wrist portion 22A and the hand portion 20A. The elastic band at the third junction 36A serves to anchor the left distal portion 14 at the user's wrist, and serves to keep the user's left hand properly positioned within the hand portion 20A.

Figure 3:
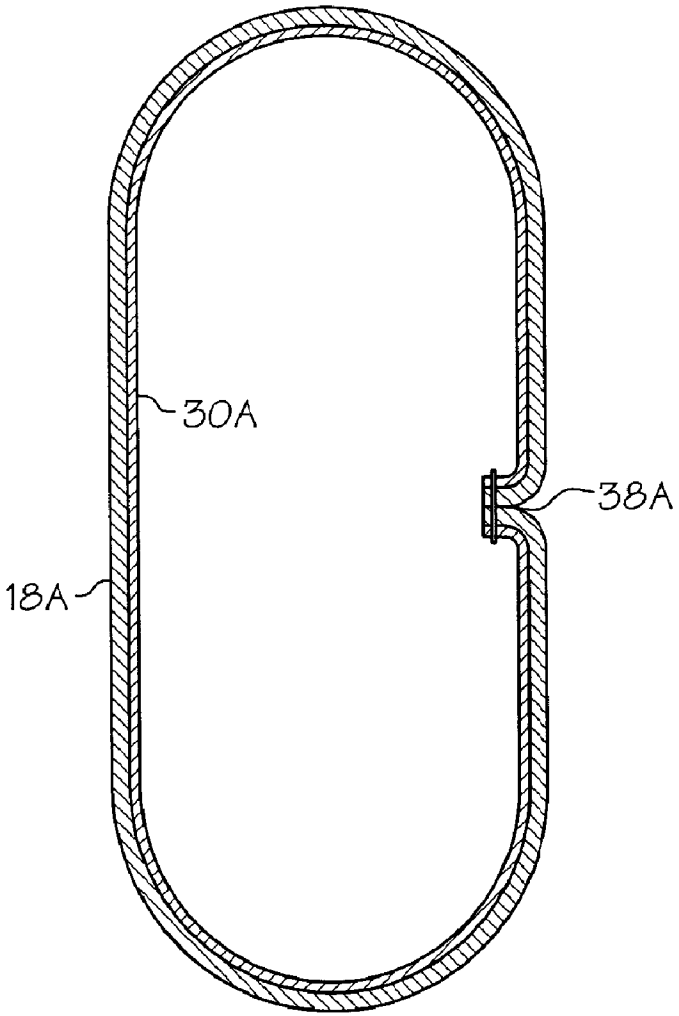
FIG. 3 is a cross-sectional view through line 3-3 of FIG. 2.

FIG. 3 illustrates the relationship of the inner-most lining 30A and the outer layer of the forearm portion 18A, as seen in cross-section through line 3-3 of FIG. 2. The hems at the first and second junctions (32A and 34A of FIG. 2) of each distal portion, as well as the seam 38 shown at the right of FIG. 3, serve to keep the two layers tight to one another as shown, so that they lie together and move in unison with one another. Similarly, the inner-most lining 30A of the wrist portion 22A and hand portion 20A is intended to lie together with, and move in unison with, the outer layer thereof. As illustrated, the outer layer (here, of the forearm portion 18A) is typically made of a thick, weather-resistant material and is thicker than the inner-most layer 30A, which is typically made of a soft, lining material. However, the thickness of these layers is not limited in this manner and can be changed, depending on the materials used.

Typically each proximal extremity portion (17, 19) is a single layer of material that continues past the first junction at each forearm portion as the inner-most lining. The material of the inner-most lining then travels beneath the outer layer of the forearm portion and is secured at the second junction, thereby providing overlap of material from the torso portion and the distal portion of the garment. This overlap permanently attaches the mitten-sleeve portion (including the hand, wrist and forearm portions) to the torso portion of the garment, and when worn keeps the mitten-sleeve portions from bunching up above the wrist. The inner-most lining is also typically included beneath the outer layer of the hand portions and wrist portions.

The inner-most lining is typically a soft, cotton-like material that is comfortable against the skin and can wick moisture away from the body, and the outer layer is typically a weather-resistant material such as fleece, that can keep the user's arms and hands warm and dry. Typically, the main bodice or torso portion of the undergarment, including the proximal extremity portions, is constructed of a soft, cotton type material, but is not limited to this material and can include any light-weight and comfortable material known in the art which is suited for wearing beneath an overcoat or sweater. In one embodiment, the material making up the inner-most lining of the forearm portions and the proximal extremity portions is separate and of a different type than the material making up the inner-most lining of the hand portions and wrist portions. In another embodiment, the material making up the inner-most lining of the hand portions, the wrist portions, the forearm portions and the proximal extremity portions is the same. In yet another embodiment, the material making up the inner-most lining of the forearm, wrist and hand portions is the same, but is separate and of a different type than that making up the proximal extremity portions.

As described above, the wrist portion of each distal portion is elasticized to ensure a snug fit over the wrist while permitting freedom of movement about the wrist area. As illustrated in FIG. 2, the hand portion 20A with the gripping surface 24A is typically in the form of a mitten. However, the hand portion 20A can also be in the form of a full glove, or even a fingerless glove. In one embodiment of the invention, designed for older children and adults, the distal portion includes a fingerless glove as the hand portion 20, which allows the user to wear a pair of outer gloves over the fingerless hand portion of the garment, yet the garment still affords the same protection around the wrist area. This embodiment is advantageous for older children and adults because it allows them to separately wear or remove the outer gloves at will, exposing the fingerless gloves underneath, thereby giving them better dexterity with their hands when desired.

To use the garment of the invention, the user will first don the torso portion 12 of the garment, typically by opening or unzipping the front closure 13 thereof, and then slip their arms into the sleeves, or proximal extremity portions 17, 19, of the garment. Thereafter, the user will maneuver each hand through the forearm portion 18 and the wrist portion 22 and then into the hand portion 20 of each distal portion 14, 16 of the garment, and then secure closed the torso portion 12 via a zipper or other front opening means. Since the garment of the invention is typically an undergarment, the user will then continue to don outerwear, such as a coat or snowsuit, by slipping each distal portion 14, 16 through the sleeves of the outerwear.

It can be appreciated that the only way for a user to insert their hands into the hand portion 20 of one of the distal portions 14, 16 will be to pass their hand through the shoulder part or proximal extremity portions of the torso portion, and then through the forearm portions, wrist portions and then into the hand portions of the distal portions of the garment. Once a hand is inside the hand portion 20, the wearer cannot remove the hand therefrom unless the entire arm and hand are removed from the proximal extremity portion of the garment. While this may be seen as restrictive of the use of the hands, the design is intended to keep the hands and wrists of the wearer warm and dry during skiing, playing in the snow, or working in the rain and cold. Removing the option (as well as the ability) to separately remove the gloves or mittens of the hand portion thus advantageously allows the wearer to enjoy the warmth and comfort of warm and dry wrists and hands without the temptation to remove the gloves and ruin a good day in the snow, and without the forearm portion of the mittens or gloves "bunching" up at the wrist and allowing outside elements or cold to touch the skin.

The garment can typically be made in any size to fit any individual, from young child to adult. For small children, the patterns used are typically for sizes 2T, 3T and 4T, but can also include sizes for children 6-12 months and 12-18 months of age.

While the present invention has been illustrated by the description of embodiments thereof, and while the embodiments have been described in considerable detail, it is not intended to restrict or in any way limit the scope of the appended claims to such detail. Additional advantages and modifications will be readily apparent to those skilled in the art. Accordingly, departures may be made from such details without departing from the scope or spirit of the invention.

What is claimed is:

1. A garment for impeding the outside elements from contacting the hands, wrists and forearms of a wearer, the garment comprising:

a) a torso portion for covering the upper torso of a wearer, the torso portion comprising a single layer and a front opening means configured to open and close the front thereof;

b) a left distal portion integral with the torso portion and comprising a left mitten-sleeve for receiving and completely enclosing the left arm and hand of the wearer; and c) a right distal portion integral with the torso portion and comprising a right mitten-sleeve for receiving and completely enclosing the right arm and hand of the wearer, wherein each of the distal portions further comprises an inner-most layer, an outer layer, and an outer-most layer, wherein both the inner-most layer and the outer layer are configured to completely cover the hand, wrist and forearm of the wearer, wherein the outer-most layer is configured to cover the outer layer at the palm, thumb and finger areas of the hand portion, wherein each distal portion is permanently sewn or hemmed to the respective side of the torso portion and prevents the wearer from exposing their hands, wrists and forearms to the outside elements unless the garment is removed.

2. The garment of claim 1, wherein the inner-most layer is made of a soft material suited for wearing against the skin, the outer layer is made of a weather-resistant material, and the outer-most layer is made of a waterproof material.

3. The garment of claim 1, wherein the inner-most layer is made of cotton, the outer layer is made of weather-resistant fleece, and the outer-most layer is made of nylon.

4. A garment for impeding the outside elements from contacting the hands, wrists and forearms of a wearer, the garment comprising:

(a) a torso portion for covering the upper torso of a wearer, the torso portion comprising a single layer, a front opening means configured to open and close the front thereof, a left proximal extremity portion and a right proximal extremity portion, each proximal extremity portion configured to cover the respective shoulder and upper arm of the wearer;

(b) a left distal portion permanently sewn or hemmed to the left proximal extremity portion. the left distal portion comprising a left mitten-sleeve for receiving and completely enclosing the left arm and hand of the wearer; and (c) a right distal portion permanently sewn or hemmed to the right proximal extremity portion, the right distal portion comprising a right mitten-sleeve for receiving and completely enclosing the right arm and hand of the wearer, each of the distal portions comprising an inner-most layer and an outer layer, wherein both the inner-most layer and the outer layer are configured to completely cover the hand, wrist and forearm of the wearer, wherein each distal portion completely encloses the respective hand, wrist and forearm of the wearer and prevents the wearer from exposing their hands, wrists and forearms to the outside elements unless the garment is removed.

5. The garment of claim 4, wherein the inner-most layer is made of a material suited for wearing against the skin, and the outer layer is made of a weather-resistant material.

6. The garment of claim 4, wherein the innermost layer is made of cotton and the outer layer is made of weather-resistant fleece.

* * * * *